United States Patent [19]

Clarke et al.

[11] Patent Number: 4,862,528

[45] Date of Patent: Sep. 5, 1989

[54] INSULATED TRAP COVER

[76] Inventors: William V. Clarke; William W. Clarke, both of 5898 Sycamore Ave., Rialto, Calif. 92376

[21] Appl. No.: 172,986

[22] Filed: Mar. 21, 1988

Related U.S. Application Data

[63] Continuation of Ser. No. 20,717, Mar. 2, 1987, abandoned.

[51] Int. Cl.[4] ..... E03C 1/00

[52] U.S. Cl. ..... 4/661; 4/418; 4/191; 4/654; 138/103

[58] Field of Search ..... 4/661, 191, 192, 418, 4/619, 638, 654, 658; 138/103, 110, 178

[56] References Cited

U.S. PATENT DOCUMENTS

| | | | |
|---|---|---|---|
| 1,156,145 | 10/1915 | Jenkins | 138/110 |
| 1,776,386 | 9/1930 | Hohmeister | 4/418 |
| 3,172,502 | 3/1965 | Wells | 138/103 |
| 3,237,716 | 3/1966 | Parsons | 138/178 |
| 3,487,478 | 1/1970 | Harris | 4/619 |
| 4,145,769 | 3/1979 | MacFarlane | 4/638 |
| 4,646,370 | 3/1987 | Risberg et al. | 4/661 |

*Primary Examiner*—Renee S. Luebke
*Assistant Examiner*—Linda S. Sholl
*Attorney, Agent, or Firm*—Harvey S. Hertz

[57] ABSTRACT

An insulated sink trap cover for a U-shaped sink trap having a vertical pipe connected to the sink drain outlet for protecting a wheelchair bound person from burning his body when using a sink. The insulated sink trap comprises a trough-shaped bottom section integrally formed with a three-sided vertical section to substantially cover the sink trap. The trough-shaped section is adapted to cover the bottom of the U-shaped sink trap, and the vertical section is adapted to cover at least three sides of the vertical pipe section of the sink trap.

3 Claims, 1 Drawing Sheet

FIG. 1
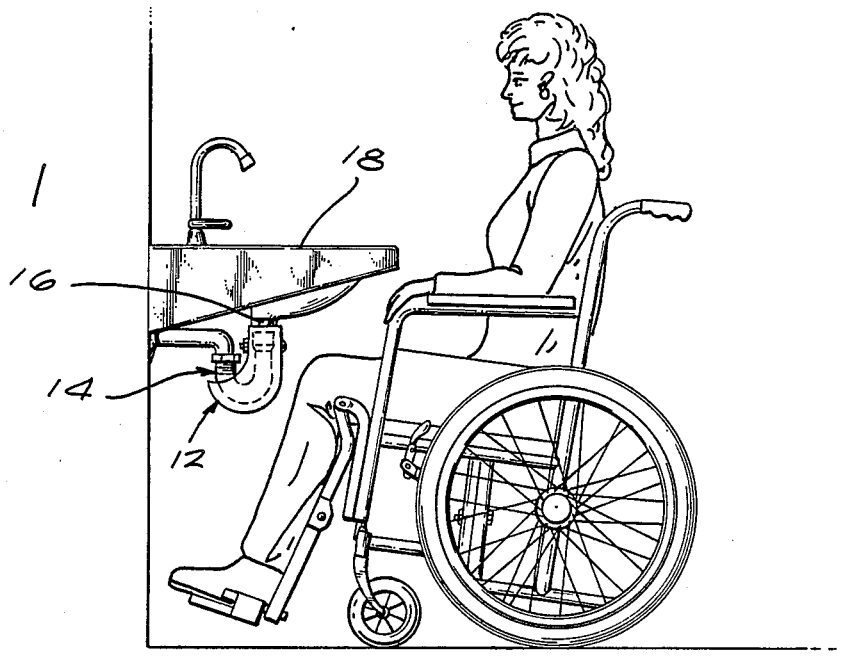
FIG 2
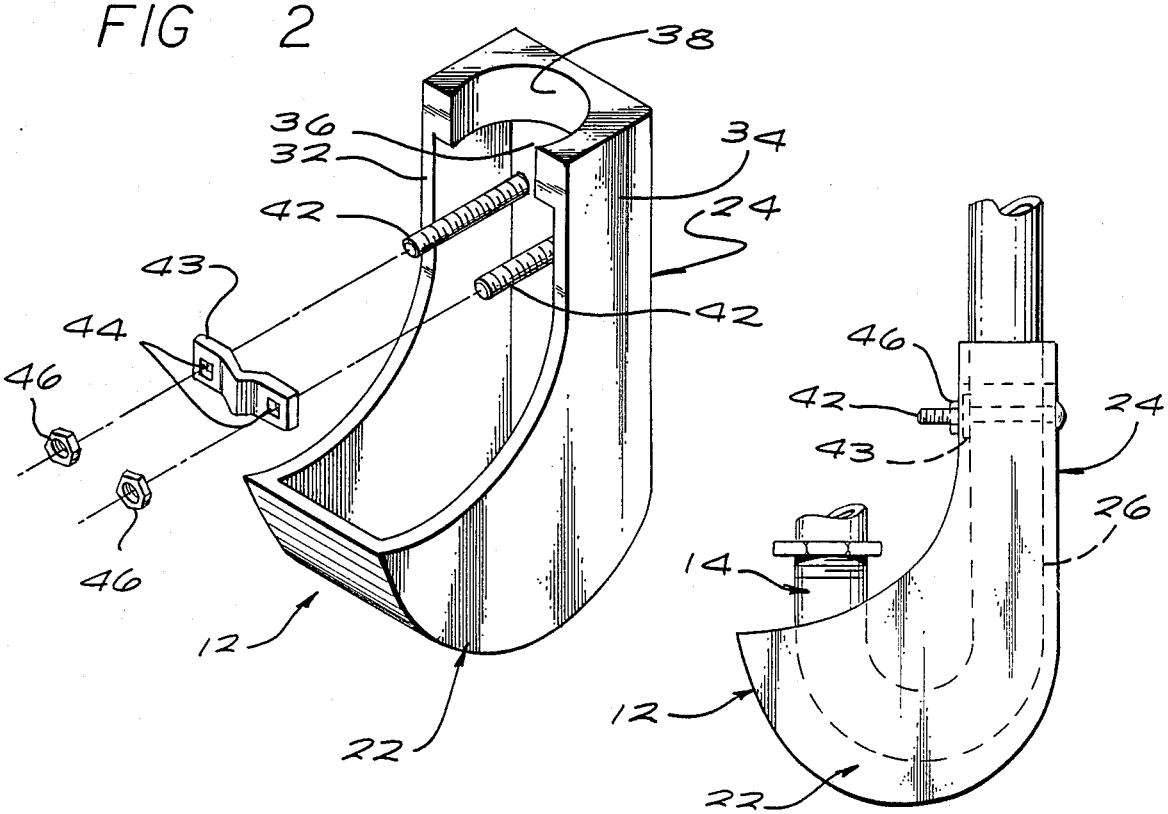
FIG. 3

INSULATED TRAP COVER

This is a continuation of co-pending application Ser. No. 020,717 filed on Mar. 2, 1987, now abandoned.

THE BACKGROUND OF THE INVENTION

1. Field of the Invention

The field of art to which the invention pertains includes the field of sink trap covers and, more particularly, to an insulated sink trap cover for use in protecting handicapped individuals utilizing a sink while seated in a wheelchair.

2. Description of the Prior Art

Handicapped persons, particularly those in wheelchairs, are susceptible to burning of their legs when utilizing a sink having an uninsulated sink trap. Conventional prior art techniques utilized insulating tape which was uwed to wrap the sink trap and thus prevent the person in a wheelchair from being burned in the leg portion of the body. However, it has been found that eventually, the insulated tape becomes loose and unwound, thus exposing the sink trap and causing burns to the legs of the wheelchair user of the sink as hot water passes through the trap.

Other insulation units surrounding pipe joings typically are formed of a pair of half sections which are molded to the exact shape of the joint and is relatively expensive. Known prior art includes U.S. Pat. Nos. 3,559,694; 3,598,157; 3,654,564; 4,142,565; 2,650,180; 4,449,554; 4,071,043; 3,556,158; 4,463,681 and 4,463,780.

SUMMARY OF THE INVENTION

An insulated sink trap cover for a U-shaped sink trap having a vertical pipe section connected to the sink drain outlet is used to protect a wheelchair person from burning this body when using the sink. The sink trap cover includes a trough-shaped bottom section integrally formed with a three-sided vertical section to substantially cover the sink trap. The trough-shaped section and vertical section are adapted to cover at least three sides of the sink trap and vertical pipe.

The advantages of this invention, both as to its construction and mode of operation, will be readily appreciated as the same becomes better understood by reference to the following detailed description when considered in connection with the accompanying drawings in which like reference numerals designate like parts throughout the figures.

BRIEF DESCRIPTION OF THE DRAWINGS

FIG. 1 is a schematic illustration of a handicapped person in a wheelchair utilizing a sink having the sink trap cover of the present invention;

FIG. 2 is an exploded perspective view of the sink trap cover of FIG. 1; and FIG. 3 is a side view of the sink trap cover illustrated mounted in a sink trap.

DESCRIPTION OF THE PREFERRED EMBODIMENTS

Referring now to the drawings, there is shown in FIG. 1 an insulated sink trap cover 12 constructed in accordance with principles of the invention. The sink trap cover 12 is illustrated mounted to cover a U-shaped sink trap 14 is connected to the drain 16 of a sink 18. Thus, when a person as illustrated in FIG. 1, utilizes the sink 18, he allows hot water to flow into the sink and, thus out the drain 16. The legs and other parts of the body of a wheelchair bound person are protected from the heat from the hot water in the sink trap 14 by means of the insulated sink trap cover 12 of the present invention.

As shown in FIG. 2 in an exploded perspective view, the insulated sink trap cover 12 contains a lower trough-shaped section 22 into which the bottom of the U-shaped sink trap is positioned in (FIGS. 1 and 3). In addition, the insulated sink trap cover 12 includes a vertical section 24 which is integrally formed with the trough-shaped section 22. The vertical section 24, as can be seen in FIG. 3, covers most of a vertical pipe 26 which interconnects the sink drain 16 to the sink trap 14. The vertical pipe 26 can be made an integral part of the U-shaped sink trap 14 as well.

Typically, the vertical section 24 of the insulated sink trap cover 12 comprises a pair of side walls 32 and 34 which are interconnected by an end wall 36. The end wall 36 in turn defines the bottom wall of the trough-shaped section 22 and the side walls 32 and 34 in turn from the side walls of the trough-shaped section.

The top portion of the vertical section 24 includes a reduced semi-circular aperture 38 which forms a tight fit with the vertical pipe 26. In addition, to secure the insulated sink trap cover 12 to the U-shaped sink trap 14, a pair of horizontal bolts 42 which are spaced apart a distance slightly greater than the diameter of the pipe 26 extend from the end wall 36 adjacent the side walls 32 and 34, respectively. When the insulated sink trap cover is positioned from beneath the sink so that it covers the U-shaped sink trap 14 into the manner shown in FIGS. 1 and 3, the bolts 42 will be positioned on opposite sides of the pipe 26. Then a clamp 43 having apertures 44 formed therein, is passed through the free end of the bolts 42 and its interior side is juxtaposed with the pipe 26. A pair of nuts 46 are secured on the bolts 42, thus clamping the sink trap cover 12 to the vertical pipe 26 and holding the sink trap cover in place as shown in FIGS. 1 and 3. Typically, the interior of the clamp 43 which surface abuts the pipe 26 may be lined so as to prevent any damage to the pipe 26 or its exterior surface.

While the insulated sink trap cover has been shown as being formed of a three sided structure, it should be understood that instead of three distinct sides, a curved surface defining the three sides could also be used as well. Typically, the insulated sink trap cover can be made of molded plastic or other well known insulating material.

As shown in FIG. 1, the dimensions of insulated trap cover 12 forwardly and laterally of the sink trap are such that the insulated trap cover, when mounted on a U-shaped sink trap, will not act as a barrier to a handicapped person seated in a wheelchair, whereby the handicapped person is able to use the sink without obstruction and without being burned by hot water flowing through the U-shaped sink trap.

Further, as can be readily seen, the insulated sink trap cover 12 of the present invention can be utilized to cover different sizes of sink traps and pipe of differing diameters.

We claim:

1. An insulated sink trap cover for an exposed U-shaped sink trap, said sink trap having a vertical pipe connected to and extending downwardly from a sink drain outlet and a U-shaped trap section having a vertical front leg connected to said vertical pipe, an arcuate section extending rearwardly therefrom to a vertical back leg connected to an outlet pipe said front leg having a front, a back, and lateral sides, said arcuate section having a front, a back, a bottom and lateral sides, said vertical pipe having a front, a rear, and lateral sides, for protecting a wheelchair bound person from burning when using the sink, said insulated sink cover comprising:

a lower trough-shaped section formed integrally with an upper section substantially to cover said sink trap said lower-trough shaped section having a front and a back with a trough generally curved from front to back, said upper section having a front side and a back side, said upper section extending from said front of said lower trough-shaped section, said lower trough-shaped section being sized to enclose said U-shaped trap section covering said front leg on the front and lateral sides thereof and said arcuate rearwardly extending section on the front, bottom, back, and lateral sides thereof with said vertical back leg extending out of said trough section, said upper section extending upwardly from said lower trough-shaped section on the front side thereof to cover said vertical pipe on the front and lateral sides thereof, the dimensions of said insulated sink trap cover forwardly and laterally of said sink trap being such that said insulated sink trap cover, when mounted on said U-shaped sink trap, will not act as a barrier to a handicapped person seated in a wheelchair, whereby said handicapped person is able to use said sink without obstruction and without being burned by hot water flowing through said U-shaped sink trap; and mounting means for so mounting said insulated sink trap cover on said sink trap, said mounting means comprising mounting members extending within said upper section from the front side thereof on opposite sides of said vertical pipe and clamping means positioned on the rear side of said vertical pipe engagable with said mounting members to clamp said sink trap cover on said vertical pipe to secure said insulated sink trap in place covering said sink trap.

2. An insulated sink trap cover in accordance with claim 1, wherein said upper section comprises a top wall having an arcuate recess opening to the rear, said recess being so dimensioned that it is positionable over and engagable with pipes of differing shapes and pipe diameters.

3. An insulated sink trap cover in accordance with claim 1, wherein said mounting members comprises a pair of bolts, and said clamping means comprises a clamping bar having a pair of openings engagable over said bolts and nuts threaded on said bolts to secure said clamp bar in engagement with said rear side of said vertical pipe.

* * * * *